US006264160B1

(12) United States Patent
Wells

(10) Patent No.: US 6,264,160 B1
(45) Date of Patent: Jul. 24, 2001

(54) COPY HOLDERS

(75) Inventor: John Stuart Wells, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 09/269,297

(22) PCT Filed: Oct. 1, 1997

(86) PCT No.: PCT/NZ97/00126

§ 371 Date: Jul. 22, 1999

§ 102(e) Date: Jul. 22, 1999

(87) PCT Pub. No.: WO98/14093

PCT Pub. Date: Apr. 9, 1998

(30) Foreign Application Priority Data

Oct. 1, 1996 (NZ) ..... 299486

(51) Int. Cl.[7] ..... A47B 97/04

(52) U.S. Cl. ..... 248/453; 248/456; 248/460; 248/462

(58) Field of Search ..... 248/453, 446, 248/447, 452, 454, 455, 457, 456, 291.1, 292.11, 292.13

(56) References Cited

U.S. PATENT DOCUMENTS 1,947,053 * 2/1934 Mason ..... 248/453
3,562,796 * 2/1971 Jacobson ..... 248/456
4,113,212 * 9/1978 Coriden ..... 248/455
4,470,571 * 9/1984 Hartman ..... 248/452
4,516,508 5/1985 Kako et al. .
4,592,528 * 6/1986 Still ..... 248/359
4,775,128 10/1988 Evenson .
5,149,046 * 9/1992 Kerley et al. ..... 248/453
5,582,382 * 12/1996 Pan-Yang ..... 248/456
5,765,799 * 6/1998 Weber ..... 248/453
5,823,504 * 10/1998 Kuwajima ..... 248/685
5,927,673 * 7/1999 Kurokawa et al. ..... 248/456

* cited by examiner

*Primary Examiner*—Anita M. King
(74) *Attorney, Agent, or Firm*—Workman, Nydegger & Seeley

(57) ABSTRACT

A copy holder is provided with a document holding stand supported adjustably by a support structure to provide a stable support while allowing operator controlled, incremental adjustment through a working range to vary the angle at which the document holding stand is supported. The adjustable support structure is provided by spring clutches on either end of a shaft which can be releasably held in housings attached to the document holding stand and these points of attachment together with a back leg provide for stable support with the incremental adjustment effected by releasing the spring clutch to adjust the gripping position on the shaft relative to the point of attachment for the back leg.

18 Claims, 2 Drawing Sheets

COPY HOLDERS

BACKGROUND OF THE INVENTION

1. Field of the Invention

This invention relates to a copy holder and/or adjustable support means particularly although not solely designed for use in providing the support for a copy holder.

2. Present State of the Art

Copy holders presently available are normally either presented at a fixed angle for the user or where adjustment is possible the adjustment is not easily made by the operator and most available adjustment mechanisms allow only a step or predetermined position adjustment.

OBJECTS AND BRIEF SUMMARY OF THE INVENTION

It is an object of the present invention to provide a copy holder and/or an adjustable support mechanism which has particular application for a copy holder that will allow for easy incremental adjustment for an operator.

Accordingly, in one aspect the invention consists a copy holder comprising a document holding stand and an adjustable support means to provide stable support for said document holding stand, said adjustable support means including a pivotal support means to allow pivotal movement between said document holding stand and said adjustable support means, a clutch means in operative engagement with said pivotal support means to hold said document holding stand in position and hand actuated control operating means to act upon and release said clutch means enabling an operator within a working range to select the angle at which the document holding stand is supported and upon such selection release of said hand actuated control means will cause the clutch means to reengage retaining said document holding stand in the selected position.

In a further aspect the invention consists in an adjustable support means comprising two housing spaced apart and designed to support a member to be adjusted, with said housing located towards the sides of said member, a shaft extending symmetrically between said housing with the ends of said shaft pivotally engageable in said housing, clutch means operable when engaged to restrain pivotal movement between the shaft and said housings, hand actuated control operating means operable to release said clutch means, a back support means extending rearwardly from said shaft so that the lower end of the two housings and the free end of the back support means creates a stable support with incremental adjustment between the housings and the support stand effected by an operator using the hand actuated control operating means to release said clutch means allowing said housings and any member supported thereby to pivot about the shaft until the selected position whereupon release of said hand actuated control operating means will allow the clutch to reengage to retain the housing and any member held thereby in the newly selected position.

BRIEF DESCRIPTION OF THE DRAWINGS

One preferred form of the invention will now be described with reference to the accompanying drawings in which.

DETAILED DESCRIPTION OF THE PREFERRED EMBODIMENT

The present invention is particularly focused on providing an adjustable copy holder but the adjustment mechanisms used herein would have application in other areas. However, the preferred embodiment of the invention will be described with particular reference to a copy holder.

Figure 1:
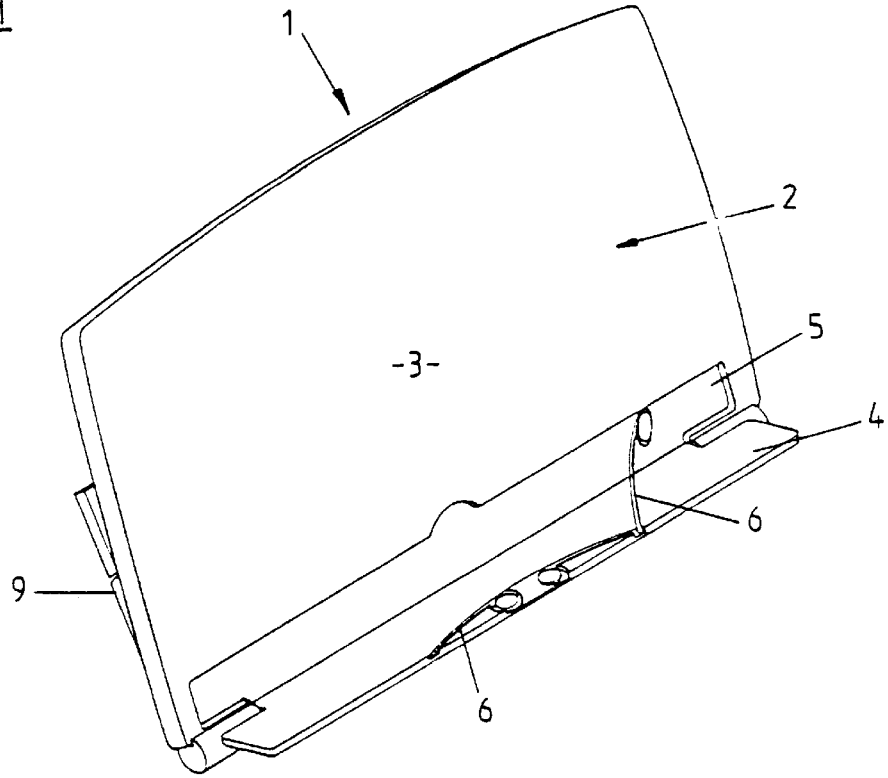
FIG. 1. is a front perspective view of a copy holder according to the present invention, FIG. 2. is a rear perspective of the copy holder, FIG. 3. is a partly diagrammatic end view showing the components in the adjustable support means used in the copy holder and, FIG. 4. is a detail of the clutch and release mechanism.
Figure 3:
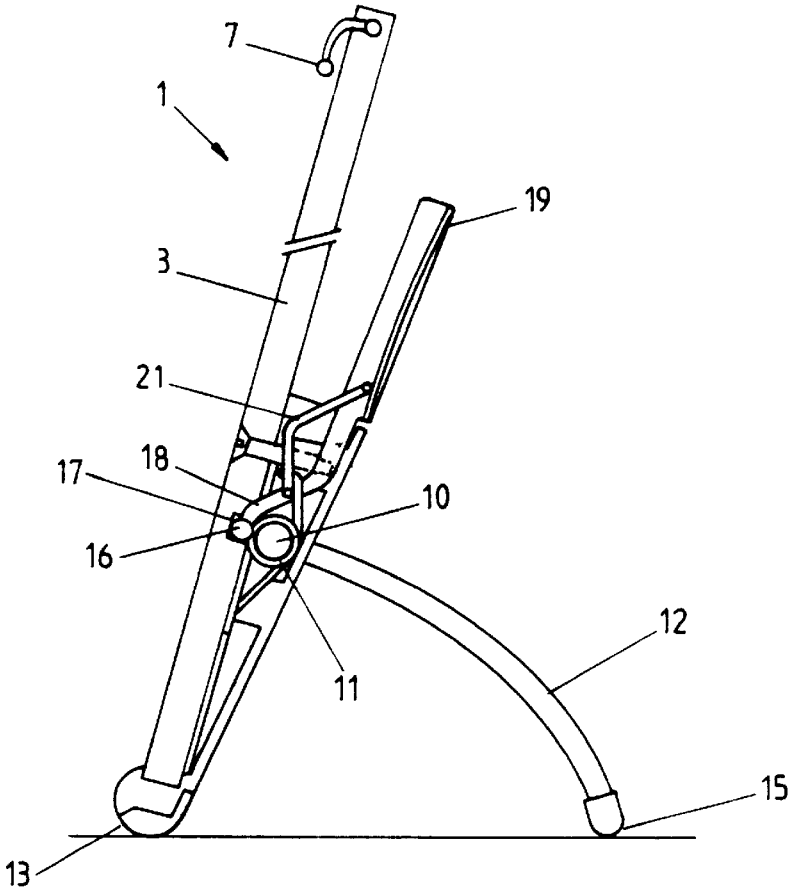
Figure 4:
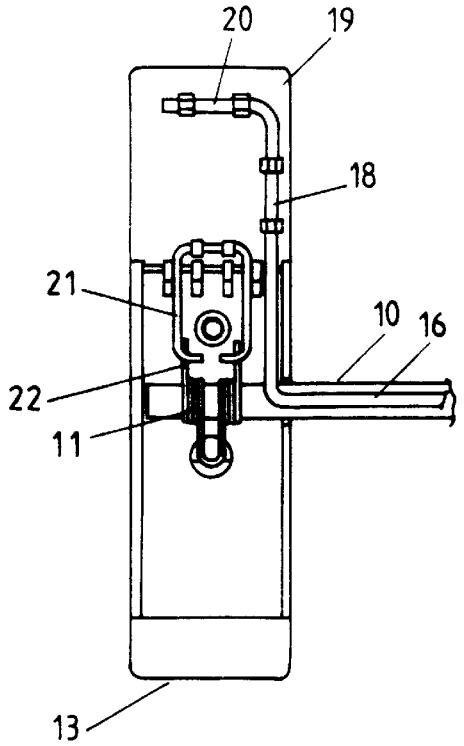

The copy holder 1, comprises a document holding stand 2 made up of a planar support member 3 desirably sized to support two A4 documents side by side, although any convenient size could be adopted and a support platform 4, pivotally mounted to move to a document supporting position as illustrated in FIG. 1 from a position where it is folded into a receiving recess 5 in the member 3. Fold away fingers 6 are provided which can be raised to assist in holding the documents in place. While this is a convenient arrangement, other arrangements would be possible, for example, with a holding means 7 at the top of the member 3 as illustrated in FIG. 3. It is desirable to include an appropriate means to ensure that the document can be held in place on the front surface of the member 3.

The document holding stand must be adjustably supported and the adjustable support means is provided to give stable support to the document holding stand but also to allow an operator controlled incremental adjustment through a working range to vary the angle at which the document holding stand is supported.

The adjustable support means comprises two housings 8 and 9 spaced apart to engage the document holding stand 2 towards each side of the member 3. The housings 8 and 9 are preferably metal castings shaped to receive and pivotally support a shaft 10 which extends there between. The shaft at least at one end within the housings 8 or 9 is gripped by a spring clutch 11 which is also retained in the housing and may be released to allow the required adjustment as will be further described later.

Figure 2:
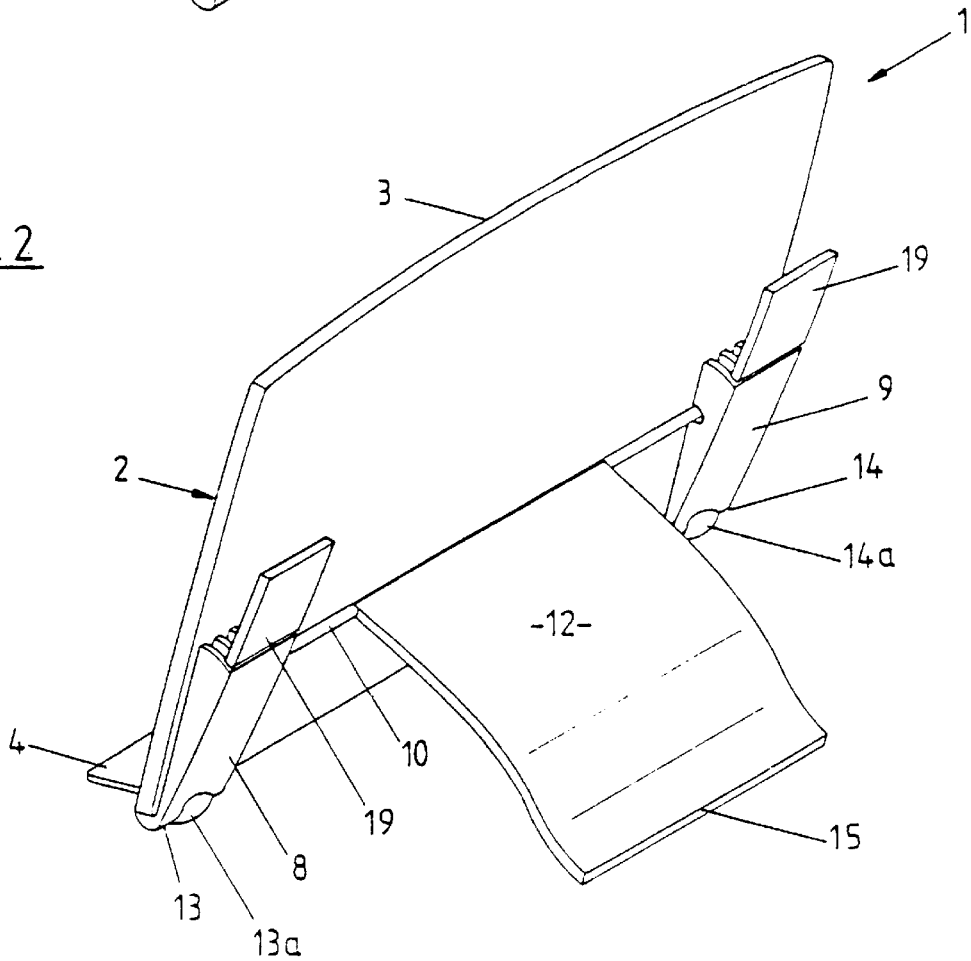

A back support means 12, is attached to the shaft 10 and can be positioned rearwardly of the shaft to complete a stable support formed by the lower ends 13 and 14 of the housings 8 and 9 and the back end 15 of the back support 12. Further pads 13*a* and 14*a* may be included to improve surface gripping. The back support means can be provided as illustrated in FIG. 2 by a shaped planar member or it could be provided by one or two spaced apart legs extending from the shaft The adjustment is effected by controlling the relative position between the point of attachment of the back leg means to the shaft and the housing with the selected position retained by the clutch 11.

In order to provide a hand operated release the spring clutch 11 it is necessary to have a lever assembly associated therewith. The lever assembly is mounted pivotally in the housing with a portion extending beyond the top of the housing to provide a grip pad 19 so that in use a hand operated squeezing action by the operator will move the lever assembly and release the clutch 11. This is achieved because the lever assembly includes lever 21 which the release arms 22 of the spring clutch releasing the spring pressure thereby allowing the shaft 10 to rotate relative to the spring clutch.

It is desirable that an operator can use either hand to effect adjustment and to this end lever assemblies are provided associated with each housing and the lever assemblies are connected to operate together. This connection is through a rod 16 which extends between the housings 8 and 9 and runs parallel to and behind the shaft 10 with the rod being located in a recess 17 formed in the member 3.

Arms 18 at each end of the rod 16 extend up and are attached to the back of the gripping pads 19. This means of attachment can be by turning a section 20 of the arm 18 at right angles and attaching this to or moulding the member in the member 19. The lever assemblies are biased to assume a position with the spring clutch engaged.

While it is desirable for the operator to be able to use either hand to effect adjustment it would be possible within the ambit of the invention to have adjustment on one side only. Because the operating levers are connected to operate together the spring clutch could be provided in one or both the housings. A sufficiently stable support can normally be achieved with the spring clutch in one of the housings.

A copy holder according to the present invention has a number of advantages. The ease of adjustment and the selection by the operator of any angle within the working range is a major advantage. It is also easy for the operator using the hand actuated adjustment to make such adjustments without difficulty. Also because of the spring clutch the mechanism cannot be overloaded and the clutch will slip before damage occurs to other components. In the preferred embodiment there is also an either handed operation.

What is claimed is:

1. A copy holder comprising a document holding stand and an adjustable support means to provide stable support for said document holding stand, said adjustable support means including a pivotal support means to allow pivotal movement between said document holding stand and said adjustable support means, a clutch means in operative engagement with said pivotal support means to hold said document holding stand in position and hand actuated control operating means to act upon and release said clutch means enabling an operator within a working range to select the angle at which the document holding stand is supported and upon such selection release of said hand actuated control means will cause the clutch means to reengage retaining said document holding stand in the selected position.

2. A copy holder comprising:

a document holding stand; and an adjustable support device, said adjustable support device including:

a back support to provide stable support for said document holding stand, said back support being pivotable relative to said document holding stand;

a clutch which is operable to restrain pivotal movement between said back support and said document holding stand; and a hand actuated clutch operating device operable to release said clutch enabling an operator within a working range to select an angle at which said document holding stand is supported by said back support and whereby, upon such selection, release of said hand actuated clutch operating device causes said clutch to re-engage, thereby retaining said document holding stand in the selected position.

3. The copy holder according to claim 2, wherein said adjustable support device further comprises:

a pair of spaced apart housings attached to a rear surface of said document holding stand; and a shaft extending between and rotationally engaged in both said housings, said back support extending rearwardly from said shaft and being mounted to said shaft for pivotal movement upon rotational motion of said shaft;

said clutch being operative to enable or prevent rotational movement of said shaft relative to said housings, which thereby enables or restrains pivotal movement between said document holding stand and said back support.

4. The copy holder according to claim 3, wherein said clutch comprises a spring clutch surrounding said shaft and being mounted in one of said housings.

5. The copy holder according to claim 4, wherein said hand actuated clutch operating device comprises a lever assembly, said lever assembly having a first finger grip portion protruding from said one of said housings and a lever in said one of said housings which is operatively connected to said spring clutch such that hand actuated squeezing of said finger grip portion toward said document holding stand releases said spring clutch, enabling rotation of said shaft relative to said housings.

6. The copy holder according to claim 5, wherein said hand actuated clutch operating device further comprises a second finger grip portion associated with the other one of said housings, said first finger grip portion and said second finger grip portion being operatively connected such that hand actuated squeezing of either said first finger grip portion or said second finger grip portion releases said spring clutch, enabling rotation of said shaft relative to said housings.

7. The copy holder according to claim 6, wherein said first and second finger grip portions are operatively connected by a connecting rod which is rotatably supported in a rear of said document holding stand, said rod having two ends with an arm extending from each end to engage with a respective one of said first and second finger grip portions such that operation of one of said first finger grip portion and said second finger grip portion transfers forces through said connecting rod to the other finger grip portion.

8. The copy holder according to claim 3, wherein said adjustable support device comprises two spring clutches surrounding said shaft, each spring clutch being mounted in a respective one of said housings.

9. The copy holder according to claim 3, wherein each of said housings has a lower end, and said back support has a back end spaced transversely from said shaft such that, in use, said lower ends of said housings and said back end of said back support engage a support surface upon which the copy holder is placed.

10. The copy holder according to claim 2, wherein said document holding stand comprises a planar member defining a support plane against which documents can be supported, and a support platform pivotably attached to a base of said planar member, said support platform being moveable from a position generally aligned with said support plane of said planar member to a position substantially at right angles thereto.

11. An adjustable support device for supporting a member, said adjustable support device comprising:

two spaced apart housings adapted to support the member, each of said housings having a lower end;

a shaft extending between and rotationally engaged in both said housings;

a back support extending rearwardly from said shaft and being mounted to said shaft for pivotal movement with rotational movement of said shaft, said back support having a back end spaced transversely from said shaft;

a clutch which is operable to enable or restrain rotational movement of said shaft relative to said housings; and a hand actuated clutch operating device operable to release said clutch;

wherein, in use, said lower end of said housings and said back end of said back support create a stable support, and an angle between said back support and said housings can be incrementally adjusted by using said hand actuated clutch operating device to release said clutch, rotating said housings relative to said shaft, and releasing said hand actuated clutch operating device to re-engage said shaft with said clutch.

12. The adjustable support device according to claim 11, wherein said clutch comprises a first spring clutch surrounding said shaft and being mounted in one of said housings.

13. The adjustable support device according to claim 12, wherein said hand actuated clutch operating device comprises a lever assembly, said lever assembly having a first finger grip portion protruding from said one of said housings and a lever in said one of said housings which is operatively connected to said first spring clutch.

14. The adjustable support device according to claim 13, wherein said hand actuated clutch operating device further comprises a second finger grip portion associated with said other one of said housings, said first finger grip portion and said second finger grip portion being operatively connected such that hand actuated squeezing of either said first finger grip portion or said second finger grip portion by an operator releases said first spring clutch, enabling rotation of said shaft relative to said housings.

15. The adjustable support device according to claim 12, further comprising a second spring clutch surrounding said shaft, said first spring clutch and said second spring clutch each being mounted in a respective one of said housings.

16. A copy holder comprising:

a document holding stand having a back surface;

a shaft rotatably mounted adjacent to said back surface of said document holding stand;

a back support coupled with said shaft such that said back support pivots as said shaft rotates;

a clutch operably connected to said shaft so as to selectively restrain rotation of said shaft; and a hand actuated clutch operating device operably connected to said clutch, said clutch operating device being selectively movable between a first position wherein said clutch engages said shaft to restrain rotation thereof and a second position wherein said clutch at least partially releases said shaft to enable selective rotation of said shaft.

17. A copy holder as recited in claim 16, further comprising a housing disposed on said back surface of said document holding stand, at least a portion of said clutch being disposed within said housing.

18. A copy holder according to claim 17, wherein said clutch operating device comprises a lever assembly having a first finger grip portion protruding from said housing and a lever disposed within said housing, said lever being operatively connected to said clutch such that hand actuated squeezing of said finger grip portion toward said document holding stand releases said clutch, enabling rotation of said shaft relative to said housing.

* * * * *

UNITED STATES PATENT AND TRADEMARK OFFICE

CERTIFICATE OF CORRECTION

PATENT NO. : 6,264,160 B1
DATED : July 24, 2001
INVENTOR(S) : John Stuart Wells

It is certified that error appears in the above-identified patent and that said Letters Patent is hereby corrected as shown below:

Column 1,
Line 6, after “particularly” and “solely” insert commas
Line 21, after “consists” insert -- of --
Lines 38, 40, 41 & 42, change “housing” to -- housings --
Line 48, change “creates” to -- create --

Column 2,
Line 47, after “shaft” insert a period
Line 51, after “release” insert -- to --
Line 52, after “clutch 11” insert a comma
Line 58, after “which” insert -- acts upon --
Line 59, after “clutch” insert -- 11 --
Line 60, after “pressure” insert a comma Column 3,
Line 6, change “moulding” to -- molding --
Line 10, after “adjustment” insert a comma Signed and Sealed this Eleventh Day of March, 2003

JAMES E. ROGAN
*Director of the United States Patent and Trademark Office*